United States Patent [19]

Koponen et al.

[11] 4,014,740

[45] Mar. 29, 1977

[54] STRUCTURE FOR TRANSFERRING A WEB FROM THE PRESS SECTION TO THE DRYING SECTION OF A PAPER MACHINE

[75] Inventors: Martti Koponen; Lassi Veijonen, both of Jyvaskyla, Finland

[73] Assignee: Valmet Oy, Helsinki, Finland

[22] Filed: Sept. 8, 1975

[21] Appl. No.: 611,423

[30] Foreign Application Priority Data

Sept. 12, 1974 Finland ..... 742670

[52] U.S. Cl. ..... 162/289; 34/120; 162/193; 162/359

[51] Int. Cl.[2] ..... D21F 7/00

[58] Field of Search ..... 162/289, 290, 255, 305, 162/359, 193, 206; 34/117, 120

[56] References Cited

UNITED STATES PATENTS

| | | | |
|---|---|---|---|
| 1,168,629 | 1/1916 | Harrigan | 162/359 |
| 1,688,267 | 10/1928 | Cram | 162/289 X |
| 2,537,129 | 1/1951 | Goodwillie | 162/290 |
| 2,944,345 | 7/1960 | Faeber | 34/120 X |

*Primary Examiner*—S. Leon Bashore
*Assistant Examiner*—Richard V. Fisher
*Attorney, Agent, or Firm*—Steinberg & Blake

[57] ABSTRACT

A structure for bringing about transfer of a paper web from the press section to the drying section of a paper machine during travel of an initial portion of a web from the press section to the drying section as well as subsequently when the travel of the web between these sections has become stabilized. A pair of rolls are situated between the last roll of the press section and the first roll of the drying section to support and guide the web during travel thereof between the press section and drying section. In addition, a weighting roll is provided to cooperate with that one of the above pair of rolls which is nearer to the drying section to define with the latter roll a nip through which an initial portion of the web travels until the operating conditions have become stabilized. A control structure is connected with the weighting roll to control the pressure at this nip as well as to displace the weighting roll away from that one of the pair of rolls which is nearer to the drying section after the travel of the web has become stabilized.

11 Claims, 3 Drawing Figures

STRUCTURE FOR TRANSFERRING A WEB FROM THE PRESS SECTION TO THE DRYING SECTION OF A PAPER MACHINE

BACKGROUND OF THE INVENTION

The present invention relates to paper machines.

In particular, the invention relates to structure in a paper machine for transferring the paper web from the press section to the drying section.

The structure of the invention is suited for use with paper machines having many different types of press sections and many different types of drying sections.

During travel of a paper web in a conventional machine, particularly a high-speed paper machine where the web travels at a relatively high rate of speed, the web is highly susceptible to breaking or tearing as it travels from the press section to the drying section particularly because at this part of its travel the web is not supported by any felt. Thus, as the web travels from the press section to the drying section in a high-speed machine, there is an unavoidable occurrence of a high-velocity air flow, the source of the latter being the rotating drying cylinders as well as the conventional ventilation system. As a result the paper web traveling between the press section and the drying section easily begins to flutter, and this latter phenomenon often results in breaking or tearing of the paper web at a part which is situated between the press section and the drying section.

Moreover, in addition to the above problem, there is the problem of initially transferring the web from the press section to the drying section. During travel of the initial portion of the web from the press section to the drying section there are even more serious problems because the manner in which the web travels has not yet become stabilized and special operating conditions are required with respect to the initial portion of the web which travels from the press section to the drying section.

SUMMARY OF THE INVENTION

It is accordingly a primary object of the present invention to provide a structure which will avoid the above drawbacks.

Thus, it is a primary object of the present invention to provide a construction which will greatly reduce the likelihood of breaking or tearing of the paper web as it travels from the press section to the drying section.

In particular, it is an object of the present invention to facilitate the so-called end insertion in connection with starting up of the paper machine, at an initial part of the operation where an initial portion of the web travels from the press section to the drying section.

However, it is also an object of the present invention to provide during normal operation of the machine when operating conditions become stabilized a reduction in the possibility of breaking or tearing of the web as it travels from the press section to the drying section at a time when the web is not supported by any felt.

According to the invention, particularly in order to facilitate the introduction of the paper web end into the drying section from the press section, there are provided a pair of rolls situated between the last roll of the press section and the first roll of the drying section, this pair of rolls serving to support and guide the web traveling between the press section and the drying section, and in cooperation with that one of this pair of rolls which is nearer to the drying section there is a weighting roll forming with the roll nearer to the drying section a nip through which the initial portion of the web travels. A control means cooperates with the weighting roll means to control the pressure between the latter and the roll which is nearer to the drying section, and this control means also serves to displace the weighting roll away from the roll nearer to the drying section after the operating conditions have become stabilized.

BRIEF DESCRIPTION OF DRAWINGS

The invention is illustrated by way of example in the accompanying drawings which form part of this application and in which.

DESCRIPTION OF PREFERRED EMBODIMENTS

Figure 1:
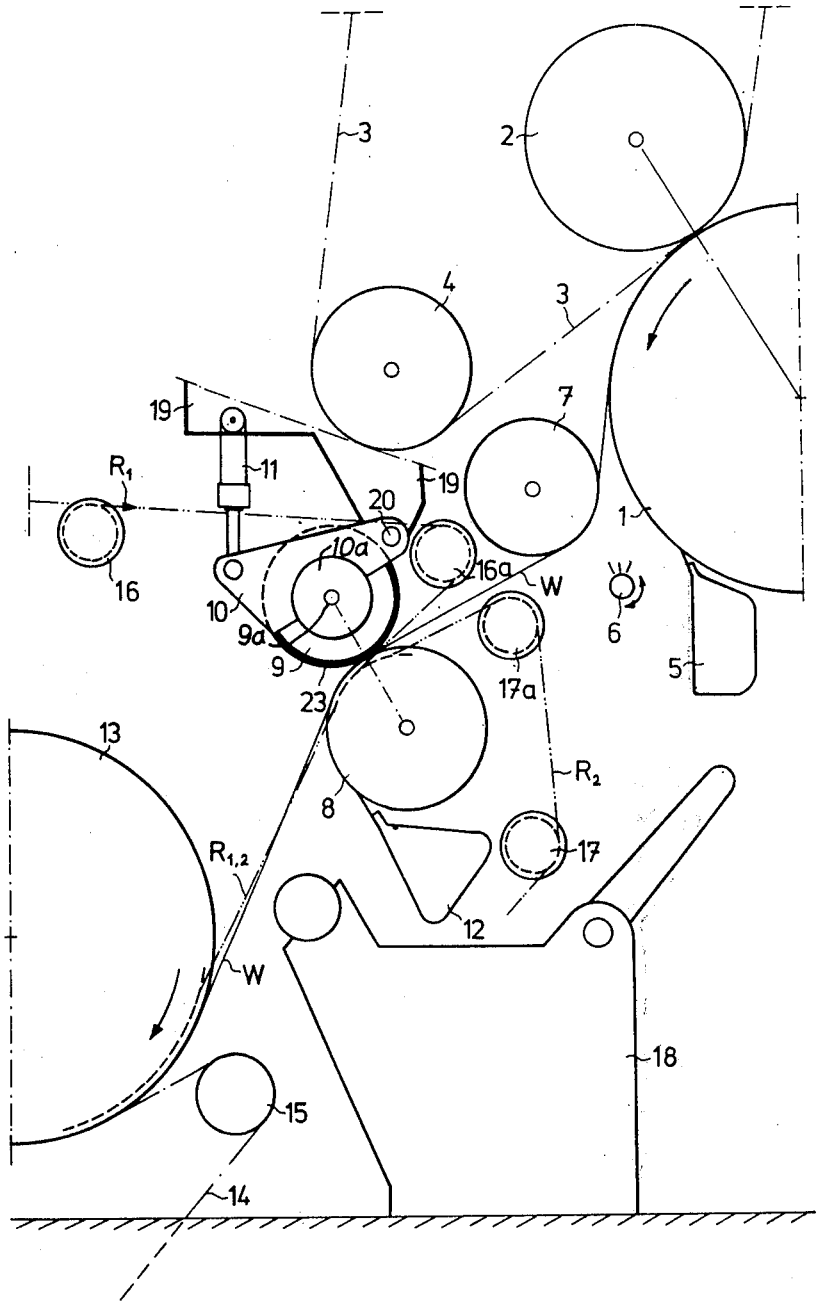
FIG. 1 is a schematic elevation showing parts of a press section and drying section and illustrating in particular the structure of the invention situated between the press section and the drying section.

Referring now to FIG. 1, there is schematically illustrated therein the last portion of a press section of a paper machine. This structure includes the last press roll 1 which is a smooth-surfaced roll and from which the web W is detached when traveling beyond the last press roll 1 of the press section to the first drying roll 13 of the fragmentarily illustrated drying section. Conventionally the web W travels without any support between the press section and the drying section, from the last press roll 1 to the first drying roll 13. The press roll 2 defines together with the roll 1 the last press nip of the press section. This roll 2 is situated within a felt loop 3 which is fragmentarily illustrated in a schematic manner and which is guided not only around the roll 2 between the latter and the roll 1 but also around the guide roll 4. A doctor blade 5 cooperates with the surface of the last press roll 1 in order to keep this surface clean. At the location where the web W becomes detached from the roll 1 there is an air-blowing nozzle 6 which in a known way can be angularly adjusted about its horizontal axis, as indicated by the double-headed arrow in FIG. 1, so that it is possible to adjust the direction of the air jet discharging from the nozzle 6. Other parts of the press section may have any desired conventional construction.

According to the present invention a roll means is situated between the last press roll 1 of the press section and the first drying roll 13 of the drying section for the purpose of supporting and guiding the web W as it travels from the press section to the drying section. This roll means of the invention includes a pair of rolls 7 and 8, with the roll 7 being situated nearer to the press section while the roll 8 is nearer to the drying section approximately midway between the roll 7 and the roll 13. Thus, the web W when initially detaching itself from the last press roll 1 will first engage the roll 7 of the pair of rolls 7 and 8 of the roll means of the invention.

From the roll 7 the web W travels to the second roll 8 of the pair of rolls 7 and 8, and from the latter roll 8 the web travels to the first drying roll 13 of the drying section. Thus, the web W by traveling around the rolls 7 and 8 in the manner illustrated in FIG. 1 is supported and guided by these rolls 7 and 8 so as to avoid problems which otherwise would be encountered if the web traveled in an unsupported condition from the roll 1 to the roll 13. During normal stabilized operation of the machine, which is to say after the starting-up operations have been completed, the web W will be supported and guided in the example of FIG. 1 only by a roll means constituted by the rolls 7 and 8 situated between the press section and the drying section.

However, in order to facilitate the starting-up operations, a weighting roll means 9 cooperates with the roll 8, which is nearer to the drying section, to define with the roll 8 a press nip through which the web travels at least at an initial portion of the web during the starting-up operations. Thus, it will be noted that the nip between the roll 8 and the weighting roll means 9 is also situated substantially midway between the roll 7 and the first drying roll 13. It is preferred to provide the weighting roll means 9, in the form of a single weight roll as illustrated, with an exterior relatively soft surface formed by a soft coating 23 made of a suitable rubber or plastic material which has elastomeric properties, although it is also possible to use suitable fabrics for the coating 23 to provide for the roll 9 a preferred softness at its exterior surface.

The weighting roll 9 has at its ends a pair of journal pins 9*a* respectively supported for rotary movement by a pair of bearings 10*a* which are fixedly carried by swingable support arms 10 which are pivoted to the frame 19 by way of coaxial pivots 20, as indicated schematically in FIG. 1. A fluid-pressure structure formed by the power cylinders 11 is also pivotally connected to the frame 19 at the cylinders thereof while the pistons have piston rods respectively pivotally connected to the pair of supporting arms 10 in the manner illustrated in FIG. 1. Thus, the power structures 11 together with the swingable levers 10 by way of the connection of the latter to the weighting roll means 9 form a control means for controlling the pressure with which the weighting roll means 9 is urged toward the roll 8 as well as for displacing the weighting roll means 9 away from the roll 8 so that the web W will no longer be engaged by the roll 9 after the operations have been stabilized. Thus, this control means which includes the power cylinders 11 or an equivalent moving structure is capable of moving the weight roll 9.

As is apparent from FIG. 1, the roll 8 has a doctor blade 12 engaging the same for a purpose referred to below.

In FIG. 1 the first drying cylinder or roll 13 of the drying section is shown together with the fragmentarily and schematically illustrated felt or fabric 14 which is guided around suitable rolls, and one of these guide rolls 15 for the endless felt or fabric 14 is indicated in FIG. 1. The path traveled by the web W includes not only the nip defined between the rolls 8 and 9 but also a path portion defined between the felt 14 and the drying cylinder or roll 13. It is of course possible to use drying sections of several different designs with the structure of the invention.

Figure 2:
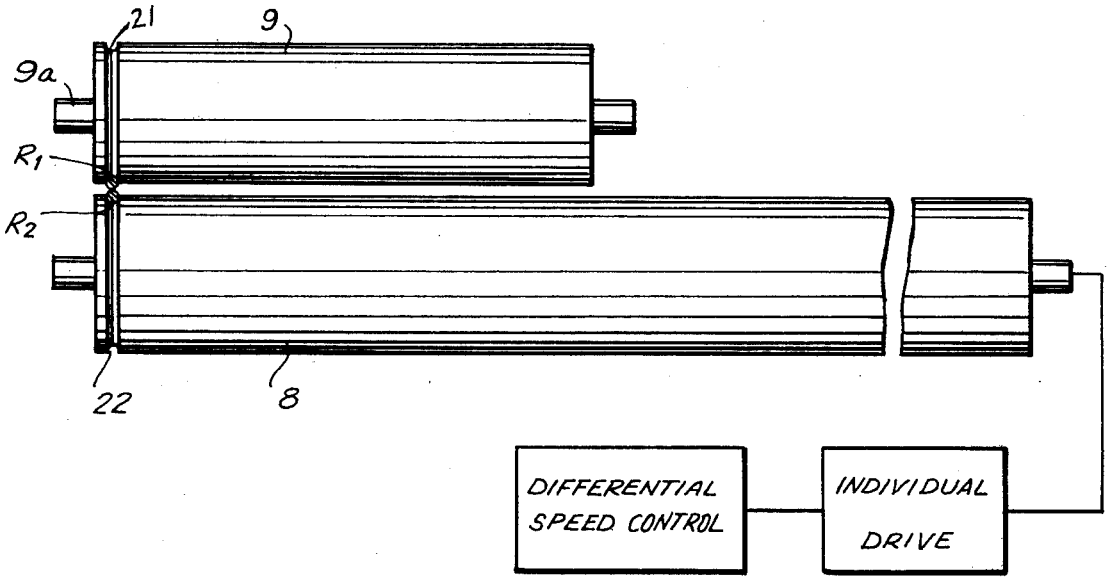
FIG. 2 is a schematic illustration of a weighting roll and a guide roll situated therebeneath and cooperating therewith, with FIG. 2 showing also in a schematic manner the structure for driving the latter guide roll.

The structure of the invention also cooperates with a web-threading system in the form of a so-called rope control system which forms part of the drying section for threading the web therethrough. The ropes of this threading system are guided in part by pulleys which form parts of some of the rolls which form the roll means of the invention. The upper control or threading rope $R_1$ is illustrated in part in FIG. 2 and is fragmentarily shown schematically in FIG. 1. Thus, this upper control rope $R_1$ passes over guiding pulleys 16 and 16*a* to be received in the rope groove 21 formed in the weight roll 9 adjacent an end of the latter, as illustrated in FIG. 2. From the roll 9 the rope $R_1$ travels on through the drying section. In the drying section the rope $R_1$ as well as the second rope $R_2$ are guided in a well known manner. In connection with the second rope $R_2$, FIG. 1 illustrates the guide pulleys 17 and 17*a* with the roll 8 being formed with a rope groove 22 which receives the rope $R_2$ from the roll 17*a*, the groove 22 being illustrated in FIG. 2. From the roll 8 the rope $R_2$ also passes on through the drying section in a conventional manner.

FIG. 1 also illustrates a saveall 18 located beneath the structure of the invention in the manner illustrated most clearly in FIG. 1.

As may be seen from FIG. 2, while the left ends of rolls 8 and 9, as viewed in FIG. 2, are situated in a common plane, the roll 9 is considerably shorter than the roll 8 since the roll 9 is used only during the starting-up operations when the operations are carried out with a tail which is cut from the initially formed web and which has a width which is substantially smaller than the total width of the web which travels through the machine when the operations have become stabilized. In addition any one of the group of three rolls 7–9 can be provided with its own individual drive means such as a suitable electric motor capable of being electrically controlled independently of other structure, so that in this way any one of the rolls 7–9 can have its speed of rotation independently regulated. FIG. 2 shows in a schematic manner an individual drive operatively connected with the roll 8 while FIG. 2 also shows in a schematic manner a differential speed control operatively connected with the individual drive so as to control the speed of rotation of the roll 8. However, although it is preferred to provide the individual drive and the differential speed control, as illustrated in FIG. 2, for the roll 8, an individual drive may be provided for any two of the rolls 7–9 or for all three rolls, and FIG. 3 schematically indicates how separate individual drives are indeed provided for the group of three rolls 7–9 so that with such an arrangement these rolls can have their speeds of rotation individually selected.

The above-described structure operates as follows.

When the paper machine is started, the full width of the paper web W is brought from the unillustrated wire section through the press section. After traveling part of the way around the last roll 1 of the press section, the web is detached from this last press roll 1 by the doctor blade 5 and is initially conducted into the saveall 18. An unillustrated oblique cutting jet, which is not illustrated and takes the form of a moving squirt of water, as is well known, acts in the wire section in order to form a tail or narrow end introduction strip which is detached from the surface of the press roll 1 with the aid of the blow nozzle 6, and thus-detached tail is in this way transferred over to the roll 7 and directed into the throat between the rolls 8 and 9 with the roll 9 being pressed against the roll 8 with a predetermined pressure determined by the power cylinders 11 at this time. In this way the initial portion of the web is caused to adhere to the surface of the roll 8 from which it is detached by way of the doctor blade 12, and the thus-detached web simply drops down into the saveall 18.

Figure 3:
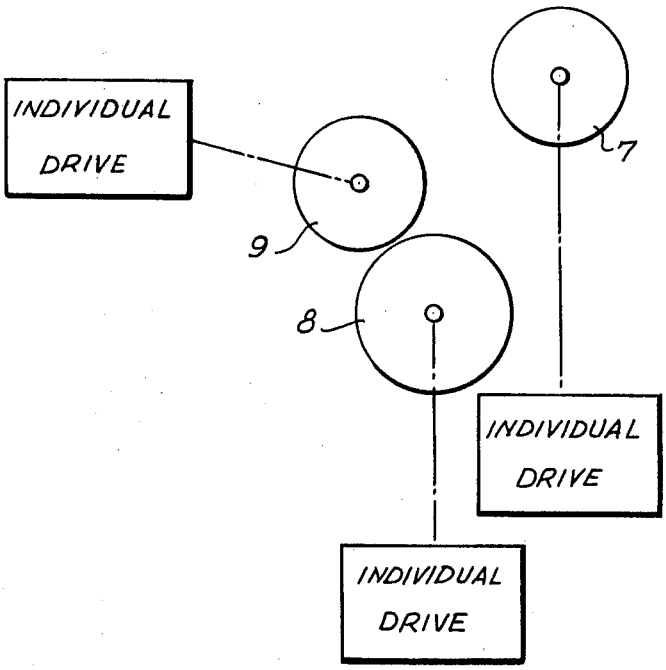
FIG. 3 is a schematic illustration of the manner in which individual drives may be provided for each of the rolls of a group of three rolls which form part of the structure of the invention.

In connection with the further conducting of the web strip to the drying section, the tension of this strip is first adjusted so as to be appropriate, and this tension adjustment is brought about by adjusting the speed of rotation of the rolls 8 and 9 by way of means in themselves known in the prior art, such as individual drives of the type shown in FIGS. 2 and 3. With the tension thus properly adjusted, the initial portion of the web is then manually inserted between the ropes $R_1$ and $R_2$ which are guided by way of the grooves 21 and 22, at the ends of the rolls 8 and 9, so that the ropes will now automatically thread the strip into the throat between the drying cylinder 13 and the felt 14, from where the ropes serve to thread the strip through the entire drying section where the strip follows the predetermined path.

After the strip has been carried in the above manner through the drying section and its course has been properly adjusted, the relatively narrow tail is terminated and the strip is widened in a well known manner, starting at the wire section, so as to form a web of full width, but the pressure between the rolls 8 and 9 still is continuously maintained. After the web of full width has run through the machine sufficiently to assume a stable operating condition, the means 11 are actuated to displace the weighting roll means 9 away from the roll 8 so that the web no longer contacts the roll 9 and instead continues to be supported and guided only by the roll means formed by the pair of rolls 7 and 8.

Thus, by way of the structure of the invention it is possible to provide the required guiding and supporting of the web W between the press section and drying section. As has been indicated above, all or any one of the rolls 7–9 may be provided with an individual drive and the roll 8 in addition may be provided with a differential speed adjustment so as to insure proper transfer operations. By way of the rolls 7–9 of the invention and the structure associated therewith, it is possible to achieve prevention of harmful air currents at the interval between the press section and drying section.

With respect to the guiding of the ropes $R_1$ and $R_2$, it is possible for these ropes to travel from the pulleys 16 and 17 directly to the rope grooves 21 and 22 of the rolls 9 and 8, respectively, so that with such a construction it is possible to omit the additional rope-guiding pulleys 16*a* and 17*a*.

As was indicated above in connection with FIG. 2, the length of the weighting roll means 9 need not be equal to that of the roll 8 since the primary function of the roll 9 is to pull the tail or end introduction strip taut. It is thus possible to provide the required operations with a weight roll 9 which may have a length on the order of one meter.

As is apparent from FIG. 1, the web W laps around only a small portion of the roll 7 and a small portion of the roll 8 so that only a minor change in the direction of travel of the web W is provided by way of the rolls 7 and 8 with the web W travelling substantially along a straight line in a generally downward direction from the roll 1 to the roll 13, so that in this way the web W while being supported by the rolls 7 and 8 is at the same time stressed to a minimum during its transfer from the press section to the drying section. The location of the roll 8 as well as the nip defined between the latter and the weighting roll means 9 substantially midway between the roll 7 and the roll 13 is particularly favorable in connection with eliminating any fluttering tendency as well as facilitating the conducting of the strip portion at the end of the web from the press section to the drying section.

Of course it is to be understood that the invention is no way confined to the specific details of the embodiments shown in the drawing and described above inasmuch as various details may be modified within the scope of the claims which follow.

What is claimed is:

1. In a paper machine, a press section having a last press roll from which a web travels beyond the press section, a drying section having a first drying roll for receiving the web travelling beyond said last press roll from said press section, roll means situated between said last press roll and said first drying roll for guiding and supporting the web as it travels from said last press roll to said first drying roll, said roll means including a pair of rolls situated along the path travelled by the web from said last press roll to said first drying roll, weighting roll means cooperating with that one of said pair of rolls which is nearer to said first drying roll for defining with said one of said pair of rolls a nip through which the web travels least when a web initially travels from the press section to the drying section, and control means cooperating with said weighting roll means for controlling the pressure between the latter and said one of said pair of rolls at least during travel of an initial portion of the web from the press section to the drying section and for displacing said weighting roll means away from said one roll when the travel of the web from the press section to the drying section while supported and guided by said pair of rolls has become stabilized, said one of said pair of rolls and the nip defined between the latter and said weighting roll means being situated substantially midway between the other of said pair of rolls and said first drying roll.

2. The combination of claim 1 and wherein each of said pair of rolls is lapped only through a relatively small angle by said web with each of said pair of rolls changing the direction of travel of said web only to a relatively small extent.

3. The combination of claim 2 and wherein said first drying roll is situated at an elevation lower than said last press roll and said pair of rolls providing for the web a substantially straight path of travel inclined downwardly from said last press roll to said first drying roll.

4. The combination of claim 1 and wherein said weighting roll means has a length substantially less than the length of said one of said pair of rolls.

5. The combination of claim 1 and wherein said weighting roll means and said one of said pair of rolls are situated substantially in a common plane at least at one of their ends, and said weighting roll means and said one roll being formed adjacent the latter ends thereof with rope grooves, respectively, and ropes of a system for threading the web through the drying section received in said grooves.

6. The combination of claim 1 and wherein said weighting roll means has a relatively soft exterior surface for engaging the web.

7. The combination of claim 1 and wherein said weighting roll means together with said pair of rolls form a group of three rolls, and an individual drive means operatively connected with at least one of said group of three rolls for controlling the drive thereof independently of other rolls.

8. The combination of claim 7 and wherein a differential speed control means is operatively connected with said individual drive means for controlling the speed thereof.

9. The combination of claim 8 and wherein said individual drive means is operatively connected with said one of said pair of rolls.

10. The combination of claim 7 and wherein a pair of said individual drive means are respectively connected with two of said group of three rolls.

11. The combination of claim 7 and wherein an individual drive means is operatively connected with each of said group of three rolls.

* * * * *